US010329870B2

(12) United States Patent
Xu et al.

(10) Patent No.: US 10,329,870 B2
(45) Date of Patent: Jun. 25, 2019

(54) SEALING ELEMENT BACKUP RING WITH INTEGRATED TAB TO CLOSE EXTRUSION PATH ALONG A MANDREL

(71) Applicant: BAKER HUGHES, A GE COMPANY, LLC, Houston, TX (US)

(72) Inventors: YingQing Xu, Tomball, TX (US); Guijun Deng, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 32 days.

(21) Appl. No.: 15/587,248

(22) Filed: May 4, 2017

(65) Prior Publication Data

US 2018/0320473 A1 Nov. 8, 2018

(51) Int. Cl.
*E21B 33/129* (2006.01)
*E21B 33/128* (2006.01)
*E21B 33/12* (2006.01)

(52) U.S. Cl.
CPC ..... *E21B 33/1292* (2013.01); *E21B 33/128* (2013.01); *E21B 33/1216* (2013.01)

(58) Field of Classification Search
CPC ..... E21B 33/1208; E21B 33/1216; E21B 33/128; E21B 33/129
See application file for complete search history.

(56) References Cited

U.S. PATENT DOCUMENTS 3,229,767 A * 1/1966 Carter ..... E21B 33/1293 166/134
4,753,444 A * 6/1988 Jackson ..... C08K 7/06 166/120
8,839,874 B2 * 9/2014 Bishop ..... E21B 33/128 166/179
2008/0190600 A1 * 8/2008 Shkurti ..... E21B 33/134 166/134
2011/0297368 A1 * 12/2011 Lembcke ..... E21B 33/1208 166/118
2012/0073830 A1 * 3/2012 Lembcke ..... E21B 33/1208 166/382
2016/0369586 A1 * 12/2016 Morehead ..... E21B 33/128

* cited by examiner

*Primary Examiner* — Kenneth L Thompson
(74) *Attorney, Agent, or Firm* — Shawn Hunter

(57) ABSTRACT

A backup ring assembly has a base ring to support the plastically deformed extrusion barrier when the packer sealing element is set. The base ring has a thin walled tapered extending ring out of the base ring and into the direction of the sealing element. The sealing element fills the annular gap volume between an upper taper on the extending ring and the body of the backup ring such that on setting the pressure internally in the seal material helps to apply a force in a direction toward the mandrel and for the full circumference of the mandrel. This force and the flexibility of the extending ring helps push the extending ring toward the mandrel outer surface to close extrusion gaps between the mandrel and the base ring of the backup ring assembly.

9 Claims, 2 Drawing Sheets

SEALING ELEMENT BACKUP RING WITH INTEGRATED TAB TO CLOSE EXTRUSION PATH ALONG A MANDREL

FIELD OF THE INVENTION

The field of the invention is packer sealing element design and more particularly backup rings that retain a sealing element in a set position against axial extrusion along a mandrel and a surrounding tubular.

BACKGROUND OF THE INVENTION

FIG. 1 illustrates a packer in a run in position akin to a Premier® model offered by Baker Hughes Incorporated of Houston, Tex. The seal element assembly 17, 18, 19 and 20 is surrounded by backup rings 15. A lower gage ring 21 holds a lock ring 22 so that the set position can be held. Slips 11 after breaking shear pin 12 mounted through a bore 13 moves axially and up the ramp of cone 14 to engage the surrounding tubular after the sealing element assembly 17, 18, 19 and 20 is axially compressed against the surrounding tubular. These parts are mounted to the outer surface of mandrel 10. To prevent extrusion between the mandrel 10 and the backup ring 15 is a wedge ring 16 that is pushed into a corner against the backup ring 15 and the mandrel 10. This ring is usually made from PEEK and is expensive to produce and very difficult to insert. Beyond that it can move during a set and become ineffective for its intended purpose if it is displaced from its original location during the set. It can be pushed out of the corner where it was inserted, roll on its axis, or simply not fully installed into the intended corner location to control axial extrusion along the mandrel.

The present invention seeks to overcome these problems by integrating an abutting ring to the extrusion barrier adjacent the mandrel to employ the forces developed in the sealing element to press the abutting ring firmly against a mandrel to close an extrusion gap there. One side of the ring is preferably an extension of the inside dimension of the base ring for the backup ring while the sealing element fills a gap between a tapered opposite side of the abutting ring and the backup ring structure. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A backup ring assembly has a base ring to support the plastically deformed extrusion barrier when the packer sealing element is set. The base ring has a thin walled tapered extending ring out of the base ring and into the direction of the sealing element. The sealing element fills the annular gap volume between an upper taper on the extending ring and the body of the backup ring such that on setting the pressure internally in the seal material helps to apply a force in a direction toward the mandrel and for the full circumference of the mandrel. This force and the flexibility of the extending ring helps push the extending ring toward the mandrel outer surface to close extrusion gaps between the mandrel and the base ring of the backup ring assembly.

DETAILED DESCRIPTION OF THE PREFERRED EMBODIMENT

Figure 1:
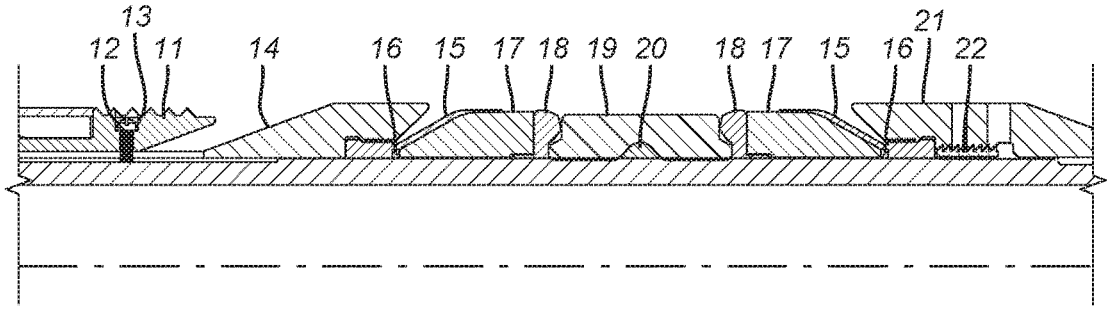
(PRIOR ART) FIG. 1
FIG. 1 is a section view of an existing design of a packer sealing element assembly shown in the run in condition.
Figure 2:
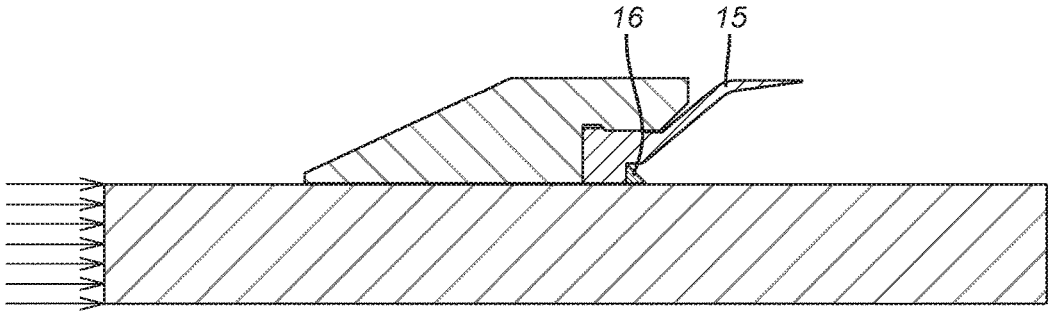
(PRIOR ART) FIG. 2
FIG. 2 is a detailed view of the backup ring of the assembly shown in FIG. 1.
Figure 3:
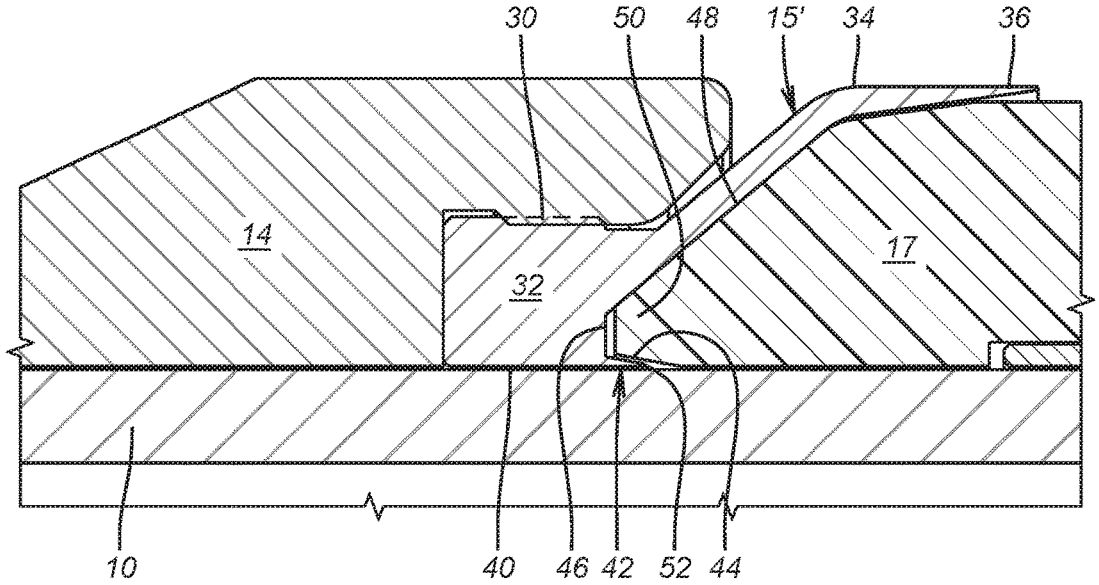
FIG. 3 is a run in view in section of a backup ring assembly featuring the extending ring from the base ring of the backup ring assembly.

FIG. 3 shows cone 14 on mandrel 10 retaining the backup ring assembly 15' at thread 30. A portion of the seal assembly in the form of sealing element 17 is also shown. The backup ring assembly has a base ring 32 located between the cone 14 and the mandrel 10. Extending from base ring 32 is the elongated structure 34 that spans over sealing element 17 with an end 36 designed to be plastically deformed against a surrounding tubular 38 to close off the annular space at the end of the sealing element 17 against the surrounding tubular 38. The set position of the structure 34 is visible in FIG. 5.

The base ring 32 has an inside surface 40 facing the mandrel 10. A flexible extending ring 42 is formed one side preferably by a continuation of surface 40 and on an opposite side by a tapered surface 44 so that the sealing element 17 will climb up on ramp surface 44 in the set position when pressure is developed inside the sealing element 17. Radial surface 46 and adjacent tapered surface 48 on the elongated structure 34 identify a pocket into which the sealing element 17 end 50 fits snugly. End 52 of the extending ring 42 is preferably blunt to avoid cutting into the sealing element 17 in the setting operation.

Figure 4:
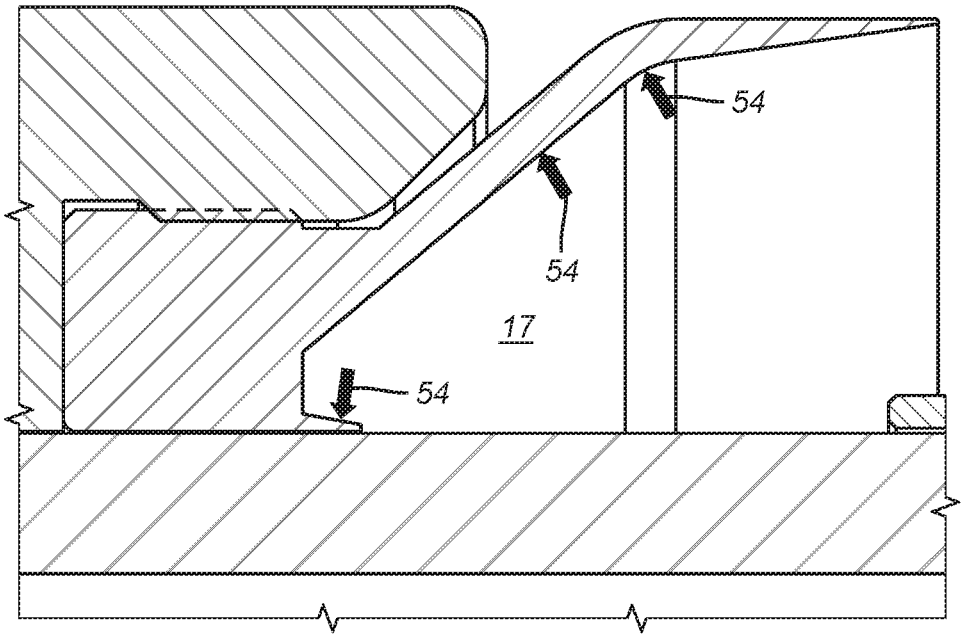
FIG. 4 is the view of FIG. 3 showing the direction of the applied forces as setting begins.
Figure 5:
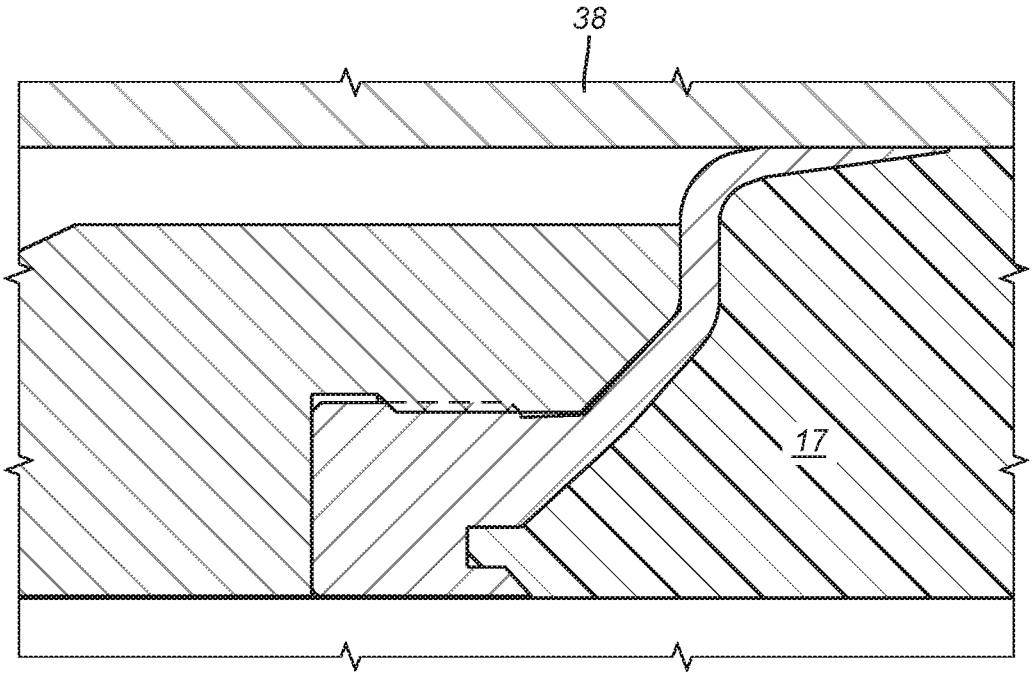
FIG. 5 is the set position showing the backup ring containing the sealing element and the extrusion gap around the mandrel closed by the flexed extending ring.

As axial compression occurs, arrows 54 schematically represent the forces generated in the sealing element 17 on the way to the set position shown in FIG. 5. As seen in FIGS. 4 and 5 the extending ring 42 is pushed against the mandrel 10 to close off any extrusion gap along the mandrel 10 outer surface. The backup ring assembly 15' extends to the surrounding tubular 38 by plastic deformation as it is bent around peripheral surfaces of the cone 14. The pressure inside the seal element 17 and the adjacent sealing elements helps maintain a pressure on the extending ring 42 in the direction of mandrel 10 principally in a radial direction. Because the extending ring 42 is a continuation of surface 40 and is built integrally to the base ring 32 and is trapped between the set seal 17 and the mandrel 10 the effectiveness of the seal against the mandrel 10 is enhanced. The flexibility of the ring 42 enables it to conform to any imperfections or out of roundness of the mandrel 10 to close off any potential extrusion paths along mandrel 10. Preferably the entire backup ring assembly 15' is manufactured out of a single workpiece in a common material but variations are envisioned where the ring 42 is of a different material or is a separate piece from the balance of the backup ring assembly 15' and secured to the base ring 32 mechanically such as with fasteners or adhesives or other fixation methods. The ring 42 is preferably a complete ring for 360 degrees in a single layer but options of multiple layers and segmented ring structure is also envisioned.

The above description is illustrative of the preferred embodiment and many modifications may be made by those skilled in the art without departing from the invention whose scope is to be determined from the literal and equivalent scope of the claims below:

We claim:

1. A barrier assembly for borehole use, comprising:

a mandrel, an anchor assembly comprising at least one slip and a sealing assembly comprising at least one sealing element assembly comprising at least one backup ring on said mandrel and against said sealing element assembly, said backup ring deforming with said sealing element assembly as said sealing element assembly is extended to a borehole wall, said backup ring further comprising an extending ring attached to a base ring, said extending ring located radially between said mandrel and said at least one sealing element assembly such that compression of said at least one sealing element assembly reduces any extrusion gap between said mandrel and said extending ring.

2. The assembly of claim 1, wherein:

said extending ring and said base ring are a single part.

3. The assembly of claim 1, wherein:

said extending ring has a bottom surface aligned with a bottom surface of said base ring.

4. The assembly of claim 1, wherein:

said extending ring has a tapered surface facing said at least one seal.

5. The assembly of claim 4, wherein:

said at least one seal when forced against the borehole wall exerting a force in said tapered surface toward said mandrel.

6. The assembly of claim 1, wherein:

said extending ring is continuous for 360 degrees.

7. The assembly of claim 1, wherein:

said extending ring comprises at least one layer.

8. The assembly of claim 1, wherein:

said extending ring defines an initial confining space for an end of said sealing element assembly.

9. The assembly of claim 1, wherein:

said extending ring has a tapered surface facing said at least one seal, said bottom surface and said tapered surface forming a blunt end.

* * * * *